US011126132B2

(12) United States Patent
Kitamura

(10) Patent No.: US 11,126,132 B2
(45) Date of Patent: Sep. 21, 2021

(54) DEVELOPING DEVICE AND IMAGE FORMING APPARATUS

(71) Applicant: KONICA MINOLTA, INC., Tokyo (JP)

(72) Inventor: Kei Kitamura, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/017,768

(22) Filed: Sep. 11, 2020

(65) Prior Publication Data

US 2021/0096500 A1 Apr. 1, 2021

(30) Foreign Application Priority Data

Oct. 1, 2019 (JP) ..... JP2019-181177

(51) Int. Cl.

| | |
|---|---|
| ***G03G 21/10*** | (2006.01) |
| ***G03G 21/16*** | (2006.01) |
| ***G03G 15/08*** | (2006.01) |
| ***G03G 15/095*** | (2006.01) |

(52) U.S. Cl.

CPC ..... *G03G 21/10* (2013.01); *G03G 15/0815* (2013.01); *G03G 15/095* (2013.01); *G03G 21/1676* (2013.01); *G03G 2221/0094* (2013.01); *G03G 2221/1684* (2013.01)

(58) Field of Classification Search

CPC ..... G03G 21/10; G03G 15/0815; G03G 21/1676; G03G 15/095; G03G 2221/1684; G03G 2221/0094

See application file for complete search history.

(56) References Cited

U.S. PATENT DOCUMENTS

| | | | | |
|---|---|---|---|---|
| 2007/0065171 | A1* | 3/2007 | Koshimura | G03G 15/0942 399/99 |
| 2008/0170876 | A1* | 7/2008 | Sakai | G03G 21/206 399/93 |
| 2009/0010660 | A1* | 1/2009 | Okada | G03G 15/0893 399/30 |
| 2009/0060560 | A1* | 3/2009 | Tamura | G03G 15/0815 399/92 |
| 2020/0310299 | A1* | 10/2020 | Uchimitsu | G03G 15/095 |

FOREIGN PATENT DOCUMENTS

JP 2015169812 A 9/2015

* cited by examiner

*Primary Examiner* — Francis C Gray

(74) *Attorney, Agent, or Firm* — Holtz, Holtz & Volek PC

(57) ABSTRACT

A developing device includes a case, a developer holder, a suction duct and a carrier catcher. The case accommodates a developer containing a toner and a carrier. The developer holder is disposed so as to face an image holder disposed outside the case and supplies the developer to the image holder. The suction duct sucks and collects a scattered toner floating in a space around the developer holder. The carrier catcher is formed in a vertical direction and disposed on a lower surface of a path of the suction duct.

15 Claims, 9 Drawing Sheets

DEVELOPING DEVICE AND IMAGE FORMING APPARATUS

CROSS-REFERENCE TO RELATED APPLICATIONS

The entire disclosure of Japanese Patent Application No. 2019-181177 filed on Oct. 1, 2019 is incorporated herein by reference in its entirety.

BACKGROUND

Technological Field

The present disclosure relates to a developing device and an image forming apparatus.

Description of the Related Art

In the electrophotographic process, a toner may be scattered because a developing roller throws the toner at a photosensitive drum at the time of developing. As a device to collect and discharge such a scattered toner to the outside of a unit, there is known a developing device having a suction duct that sucks the scattered toner. (See, for example, JP 2015-169812 A.)

SUMMARY

In order for the suction duct to effectively suck the scattered toner, it is desirable to arrange the intake port thereof near the developing roller. However, this arrangement may cause the suction duct to suck not only the toner but also a carrier unintentionally.

When the carrier enters a suction path on the main body side, the carrier is deposited/accumulated in the path, so that the cross section of the flow path becomes narrow, and accordingly a necessary air flow rate cannot be obtained. As a result, the suction duct cannot suck the scattered toner sufficiently. The suction path on the main body side is difficult to clean, and hence a situation where image failure occurs daily may occur.

Objects of the present disclosure include providing a developing device and an image forming apparatus that can prevent a carrier from entering the main body side, the carrier entering a suction duct when the suction duct sucks a scattered toner.

In order to achieve at least one of the abovementioned objects, according to an aspect of the present disclosure, there is provided a developing device including:

a case that accommodates a developer containing a toner and a carrier;

a developer holder that is disposed so as to face an image holder disposed outside the case and supplies the developer to the image holder;

a suction duct that sucks and collects a scattered toner floating in a space around the developer holder; and a carrier catcher that is formed in a vertical direction and disposed on a lower surface of a path of the suction duct.

In order to achieve at least one of the abovementioned objects, according to another aspect of the present disclosure, there is provided an image forming apparatus including the developing device.

BRIEF DESCRIPTION OF THE DRAWINGS

The advantages and features provided by one or more embodiments of the present invention will become more fully understood from the detailed description given hereinbelow and the appended drawings that are given by way of illustration only, and thus are not intended as a definition of the limits of the present invention, wherein.

DETAILED DESCRIPTION OF EMBODIMENTS

Hereinafter, one or more embodiments of the present invention will be described in detail with reference to the drawings. However, the scope of the present invention is not limited to the disclosed embodiments or illustrated examples.

Image Forming Apparatus

First, the overall configuration of an image forming apparatus 100 according to an embodiment(s) will be described.

Figure 1:
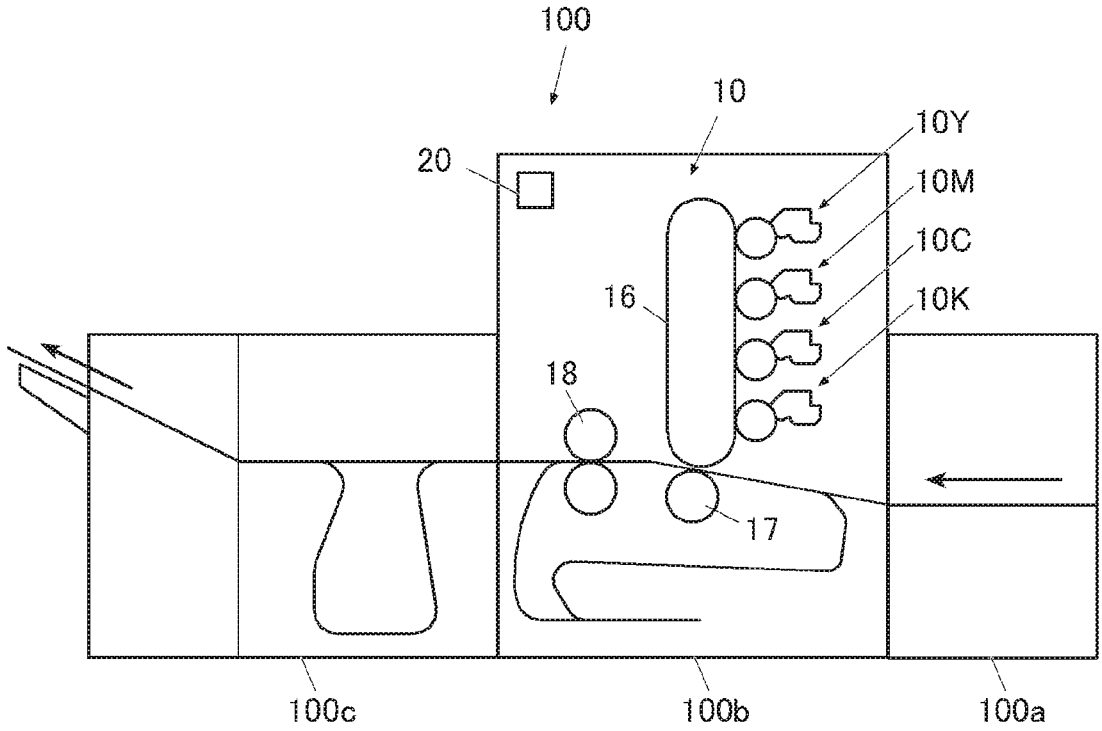
FIG. 1 shows a schematic configuration of an image forming apparatus.

FIG. 1 shows a schematic configuration of the image forming apparatus 100.

As shown in FIG. 1, the image forming apparatus 100 includes a paper feed unit 100*a*, a main body unit 100*b* and a paper ejection unit 100*c*.

The paper feed unit 100*a* includes a large-capacity paper feed tray (not shown), and conveys sheets of paper to the main body unit 100*b* from the paper feed tray in response to instructions from the main body unit 100*b*.

The main body unit 100*b* is, for example, an electrophotographic full-color image forming apparatus employing a tandem printing system (having a plurality of writing units) and an intermediate transfer system, and includes an image forming unit 10 and a controller 20.

The main body unit 100*b* forms images on sheets of paper fed from the paper feed tray of the paper feed unit 100*a* or a paper feed tray(s) (not shown) of the main body unit 100*b*, and conveys the sheets with the images formed to the paper ejection unit 100*c*.

The paper ejection unit 100*c* ejects sheets of paper conveyed from the main body unit 100*b*. The paper ejection unit 100*c* may include paper processing units (not shown) for performing a predetermined type(s) of paper processing on the sheets conveyed from the main body unit 100*b* as necessary (only when instructed by the main body unit 100*b*). Examples of the paper processing include stapling, punching, folding and bookbinding.

The image forming unit 10 forms images composed of four colors of Y, M, C, K (YMCK images) on sheets of paper on the basis of pixel values of the four colors of each pixel of processed original images.

The image forming unit 10 includes four writing units 10Y, 10M, 10C, 10K, an intermediate transfer belt 16, a pair of second transfer rollers 17 and a fusing unit 18.

Figure 2:
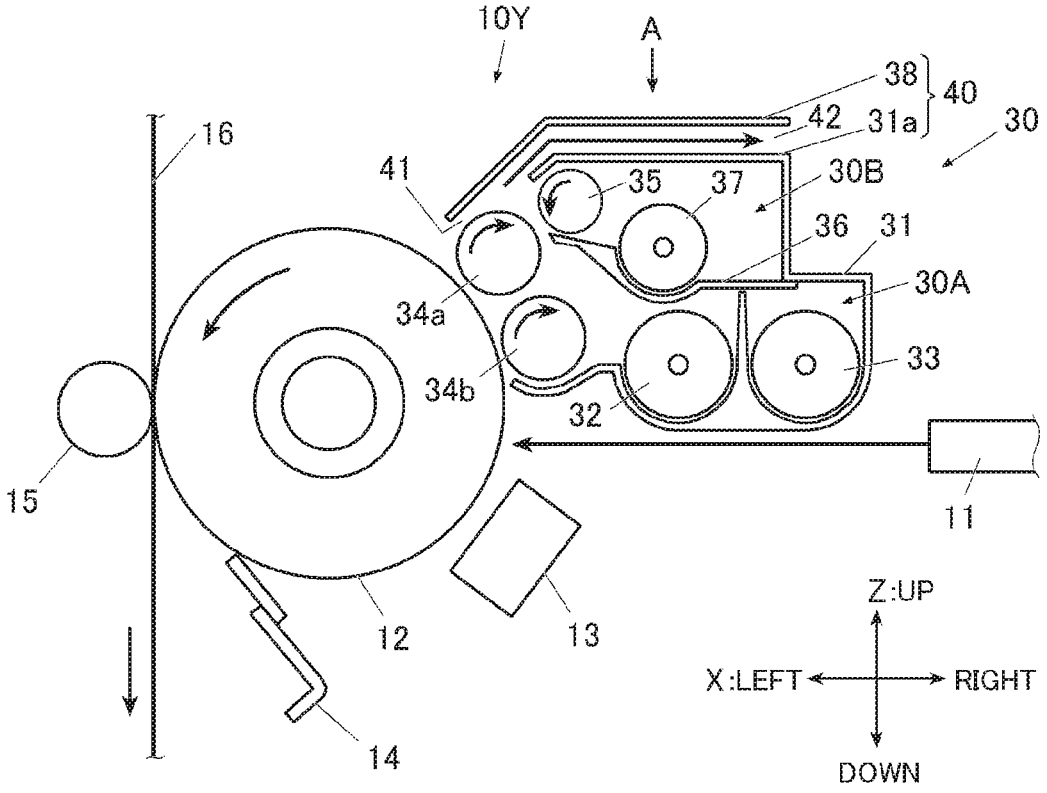
FIG. 2 shows a writing unit and the periphery thereof in an image forming unit.

FIG. 2 shows the writing unit 10Y and the vicinity thereof in the image forming unit 10.

The four writing units 10Y, 10M, 10C, 10K are arranged in the vertical direction along the belt surface of the intermediate transfer belt 16, and form Y, M, C, K images, respectively.

The writing units 10Y, 10M, 10C, 10K are the same in configuration. Difference therebetween is only the color of images to form. Each of the writing units 10Y, 10M, 10C, 10K includes, as shown in FIG. 2, an optical scanner 11, a photoconductor 12 (image holder), a charger 13, a cleaner 14, a first transfer roller 15 and a developing device 30.

At the time of image forming, in each of the writing units 10Y, 10M, 10C, 10K, the charger 13 charges the photoconductor 12, the optical scanner 11 emits a beam on the basis of an original image to scan the charged photoconductor 12, thereby forming an electrostatic latent image, and the developing device 30 supplies a color material, such as a toner, to develop the electrostatic latent image, thereby forming a toner image on the photoconductor 12.

The images formed on the photoconductors 12 of the four writing units 10Y, 10M, 10C, 10K are successively transferred onto the intermediate transfer belt 16 by their respective first transfer rollers 15 so as to be superimposed on top of one another (first transfer), so that an image composed of multiple colors (YMCK image) is formed on the intermediate transfer belt 16. The intermediate transfer belt 16 is wound around a plurality of rollers and rotates. After the first transfer, the cleaners 14 remove the color materials remaining on the respective photoconductors 12.

In the image forming unit 10, a sheet of paper is fed from a paper feed tray to the position of the second transfer rollers 17 so as to coincide with the YMCK image formed on the rotating intermediate transfer belt 16 reaching the position of the second transfer rollers 17. One of the second transfer rollers 17, which form a pair, contacts the intermediate transfer belt 16 by pressure. The other is one of the rollers around which the intermediate transfer belt 16 is wound. After the YMCK image on the intermediate transfer belt 16 is transferred onto the sheet by the pressure contact of the second transfer roller(s) 17 (second transfer), the sheet is conveyed to the fusing unit 18 to be subjected to fusing, and then conveyed to the paper ejection unit 100*c*.

The controller 20 includes a central processing unit (CPU), a random access memory (RAM) and a read only memory (ROM), and controls operation of each component of the image forming apparatus 100.

Developing Device

Next, the developing device 30 will be described in detail.

In the following description, the width direction (right-left direction), the depth direction (front-back direction) and the height direction (up-down direction) of the developing device 30 may be referred to as X direction, Y direction and Z direction, respectively.

The developing device 13 is set so as to extend along the axial direction (Y direction) of the photoconductor 12.

The developing device 30 has, inside, a developer agitating unit 30A and a developer collector 30B, and includes a case 31 that accommodates a developer containing a toner and a carrier.

The developer agitating unit 30A is located at the lower part in the case 31, and includes a main agitator 32, an auxiliary agitator 33 and two (first and second) developing rollers 34*a*, 34*b* (developer holders).

The main agitator 32 and the auxiliary agitator 33 convey the developer in the axial direction by rotating, and agitate the developer by circulating the developer between (from/to) the region of the main agitator 32 and (to/from) the region of the auxiliary agitator 33 in the developer agitating unit 30A. The developer is partly conveyed to the developing rollers 34*a*, 34*b* while being agitated.

The first developing roller 34*a* is disposed above the second developing roller 34*b* and faces the photoconductor 12.

The first developing roller 34*a* receives the developer from the second developing roller 34*b* by magnetic force at a portion facing the second developing roller 34*b*, and conveys the developer to a first developing nip portion where the first developing roller 34*a* faces the photoconductor 12. The developer conveyed by the first developing roller 34*a* to the first developing nip portion is supplied to the photoconductor 12 thereat.

The second developing roller 34*b* faces the photoconductor 12 on the upstream side of the first developing nip portion in the rotation direction of the photoconductor 12.

The second developing roller 34*b* attracts the developer in the developer agitating unit 30A by magnetic force, and conveys the developer to a second developing nip portion where the second developing roller 34*b* faces the photoconductor 12. The developer conveyed by the second developing roller 34*b* to the second developing nip portion is supplied to the photoconductor 12 thereat.

The developer collector 30B is located above the developer agitating unit 30A in the case 31, and includes a collecting roller 35, a collected developer storage 36 and a collected developer conveyor 37.

The collecting roller 35 collects the developer (toner) on the first developing roller 34*a* not supplied to the photoconductor 12.

More specifically, the collecting roller 35 is disposed so as to face the first developing roller 34*a* on the side of the first developing roller 34*a* opposite to the side where the first developing roller 34*a* faces the photoconductor 12, and collects the developer on the first developing roller 34*a* by magnetic force on the downstream side of the first developing nip portion in the rotation direction of the first developing roller 34*a*. The developer collected by the collecting roller 35 is accommodated in the collected developer storage 36.

The collected developer conveyor 37 conveys the developer in the collected developer storage 36 in the axial direction (Y direction).

At the lower end of the collected developer storage 36 on the back side in the Y direction, an opening (not shown) is formed. The developer conveyed inside the collected developer storage 36 by the collected developer conveyor 37 goes back to the developer agitating unit 30A disposed below through the opening.

The developing device 30 includes a suction duct 40.

The suction duct 40 is formed by an upper surface 31*a* of the case 31 and a cover 38 disposed above the case 31.

The cover 38 is set at a position a predetermined distance away from the upper surface 31*a* of the case 31 so as to cover the upper surface 31*a* of the case 31. The cover 38 is detachably attached to the case 31.

Because the cover 38 is disposed so as to cover the upper surface 31*a* of the case 31, in a top view, the suction duct 40 is set so as to extend along the axial direction of the photoconductor 12.

The suction duct 40 sucks air by a fan (not shown) being driven, thereby sucking a scattered toner floating in the vicinity of the first developing roller 34*a* and a space therearound.

An intake port (suction port) 41 of the suction duct 40 is disposed on the downstream side of the first developing roller 34*a* in the rotation direction of the photoconductor 12.

In the image forming unit 10, four suction ducts 40 of the four writing units 10Y, 10M, 10C, 10K are disposed. Air that contains a color toner (toner-containing air) scattered in each of the writing units 10Y, 10M, 10C, 10K passes through a suction duct 40 therefor.

Figure 3:
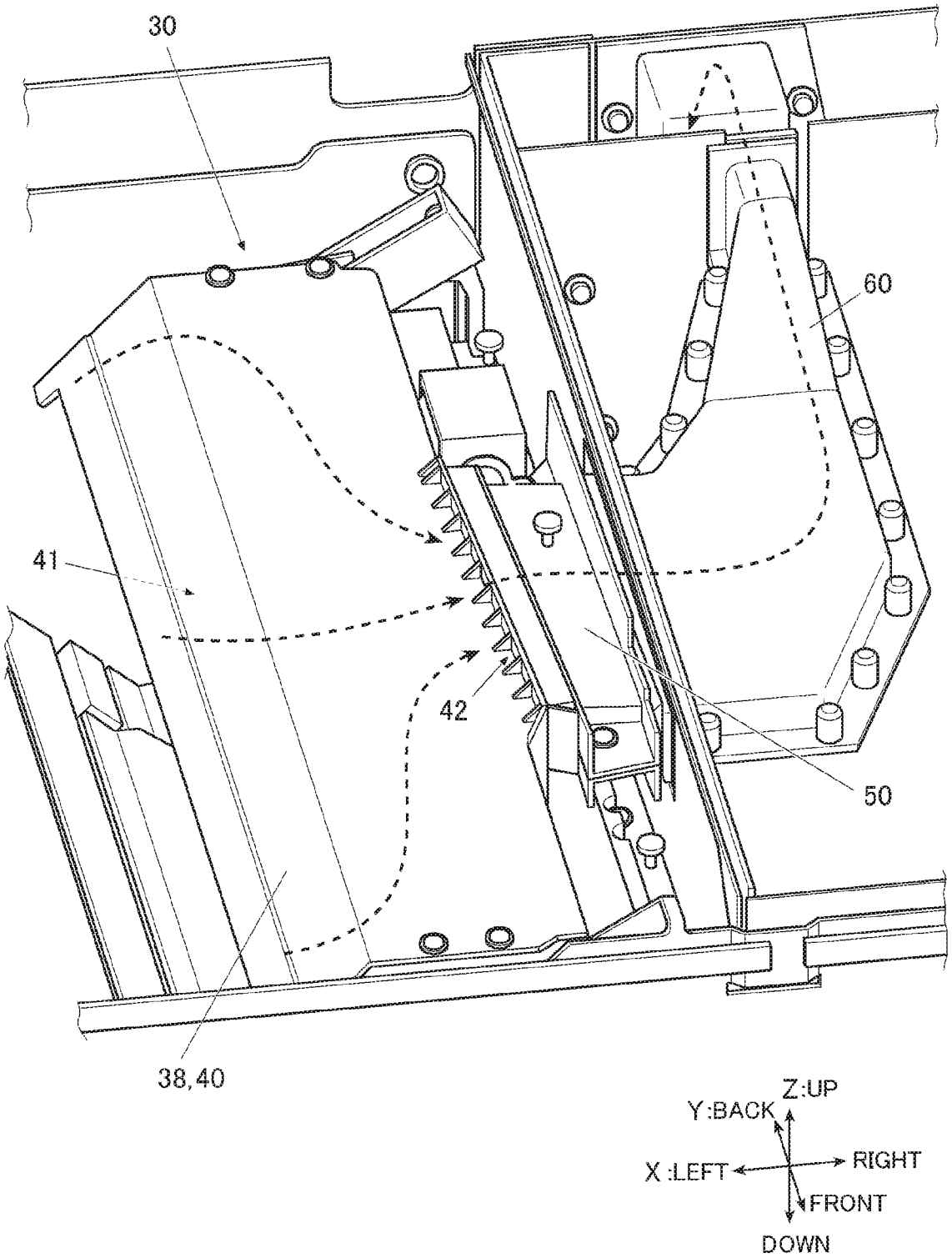
FIG. 3 shows a developing device viewed from above.
Figure 4:
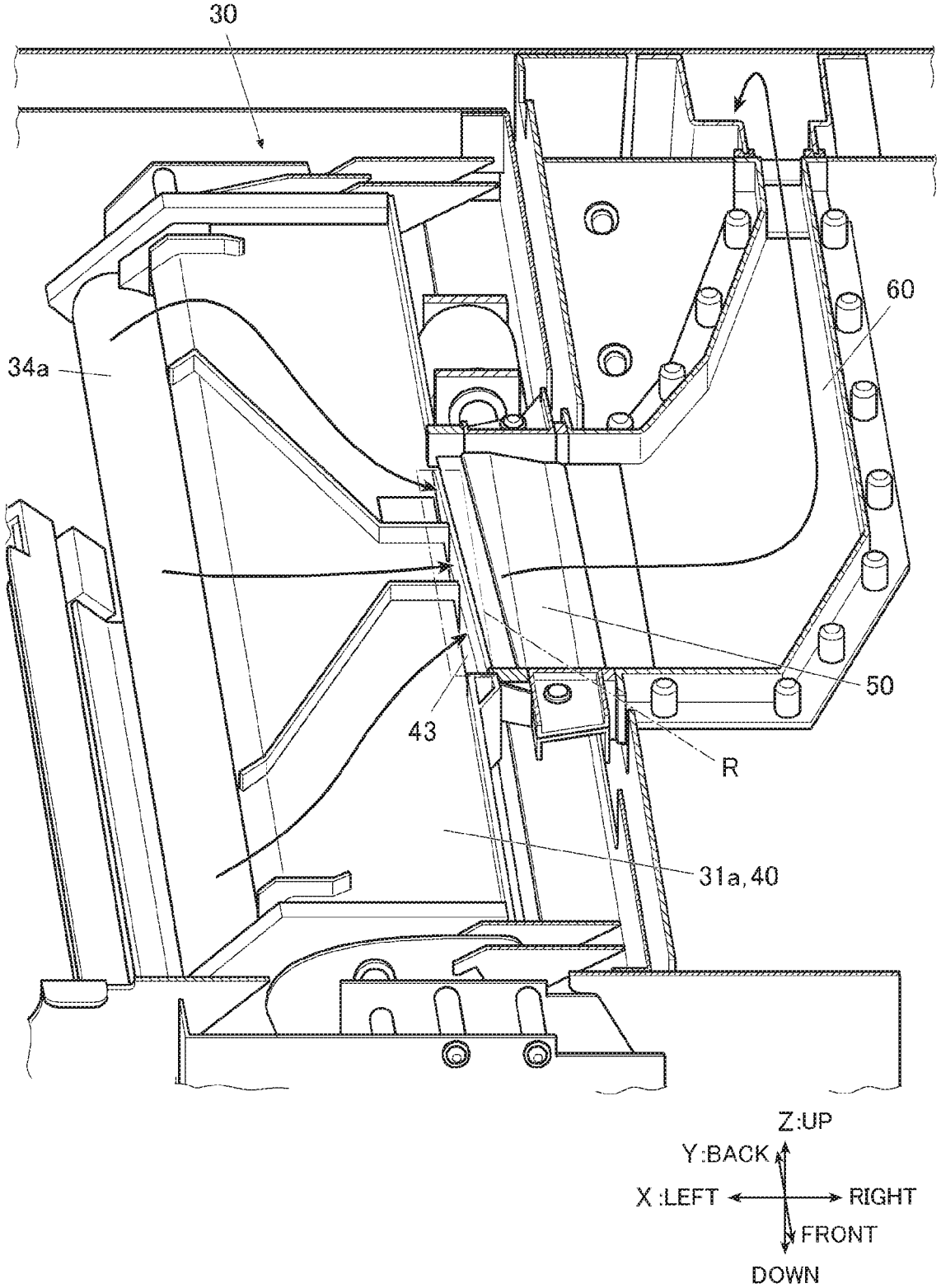
FIG. 4 shows the developing device viewed from above.

FIG. 3 shows the developing device 30 viewed from a direction indicated by an arrow A shown in FIG. 2. FIG. 4 shows the developing device 30 shown in FIG. 3 with the cover 38 removed.

As shown in FIG. 3, an exhaust port 42 of the suction duct 40 is connected, via a cylindrical connector 50, to a main-body-side duct 60 disposed in the main body unit 100*b*. The connector 50 is a component having a role of a junction of the suction duct 40 and the main-body-side duct 60. The toner-containing air flowing in the suction duct 40 flows into the main-body-side duct 60 through a space in the connector 50.

As shown in FIG. 3 and FIG. 4, the intake port 41 of the suction duct 40 is formed so as to be open for the entire length of the photoconductor 12 in its extending direction (Y direction), and the exhaust port 42 of the suction duct 40 is formed with a length that allows only the central portion of the suction duct 40 in the Y direction to open.

That is, the suction duct 40 is formed such that the length in the Y direction (width) becomes shorter from the intake port 41 to the exhaust port 42, so that the flow rate is higher in the vicinity of the exhaust port 42. Hence, as indicated by arrows in FIG. 3 and FIG. 4, the scattered toner (particles) sucked into the intake port 41 gathers in the vicinity of the exhaust port 42, and is sucked into the space in the connector 50.

The developing device 30 is detachable from and attachable to (can be pulled out from and inserted into) the main body unit 100*b*, and can be cleaned at a predetermined timing.

Figure 5A:
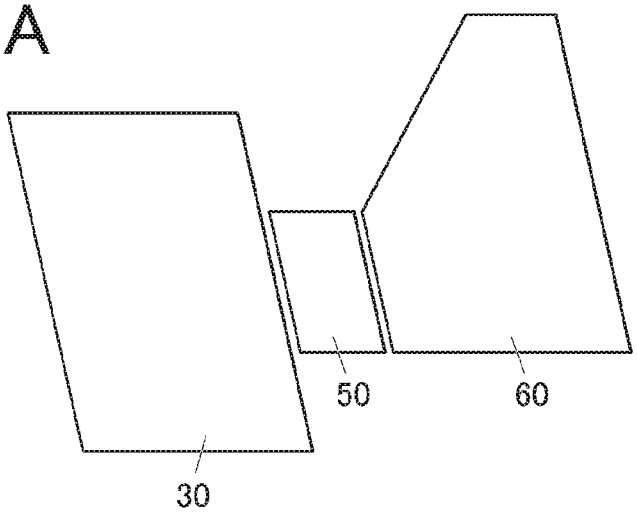
FIG. 5A is an illustration for explaining how to detach and attach the developing device.
Figure 5B:
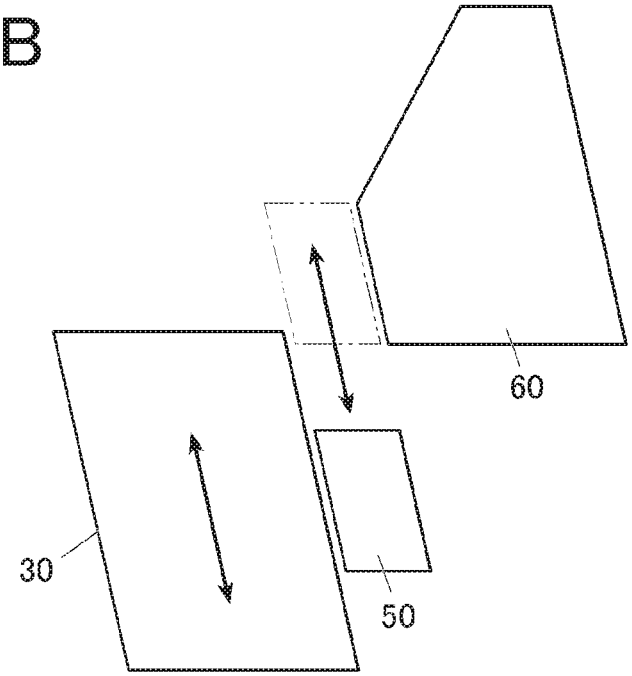
FIG. 5B is an illustration for explaining how to detach and attach the developing device.
Figure 5C:
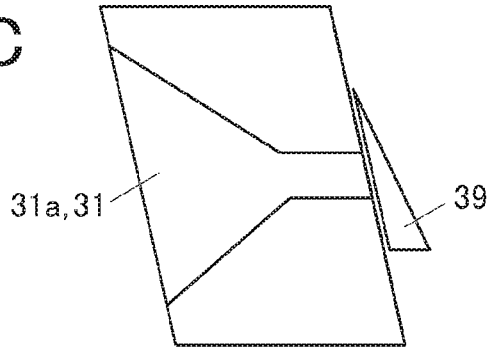
FIG. 5C is an illustration for explaining how to detach and attach the developing device.

When the developing device 30 is pulled out from the main body unit 100*b*, the developing device 30 in its set state shown in FIG. 5A is pulled toward the near side (front side) as shown in FIG. 5B, so that the developing deice 30 can be removed from the main body unit 100*b*. At the time, as shown in FIG. 5B, the connector 50 is pulled out together with the developing device 30. As described above, in the image forming apparatus 100 of this embodiment, four developing devices 30 for respective color toners are disposed. These developing devices 30 can be individually pulled out from the main body unit 100*b*. The developing device 30 pulled out from the main body unit 100*b* can be cleaned. More specifically, as shown in FIG. 5C, the cover 38 is removed, and the upper surface 31*a* of the case 31 is cleaned. After cleaned, the developing device 30 with the cover 38 set thereon is attached to the main body unit 100*b* via the connector 50. It is possible that the developing device 30 once detached is discarded, and a new developing device 30 is attached.

As shown in FIG. 5C, the case 31 is provided with a tapered part 39. When the developing device 30 is pulled out from or attached to the main body unit 100*b*, the tapered part 39 holds a seal of the connector 50. This prevents the seal from being turned up, which is caused by the connector 50 and the case 31 rubbing against one another.

Carrier Catcher

When the scattered toner is sucked by the suction duct 40, the carrier may be unintentionally sucked together with the toner. When the carrier enters the main-body-side duct 60, because, for example, the main-body-side duct 60 cannot be easily cleaned, the carrier may be deposited/accumulated in the path of the main-body-side duct 60 and narrow the cross section of the flow path. This may cause a situation where the scattered toner cannot be sucked sufficiently.

Hence, in the present disclosure, the suction duct 40 has a carrier catcher for preventing the carrier from entering the main-body-side duct 60.

In the image forming apparatus 100 of this embodiment, because the photoconductors 12 line up vertically, the scattered toner is sucked sideways (right-left direction). Accordingly, wind flows sideways, and hence providing the carrier catcher in the vertical direction is effective.

Figure 6:
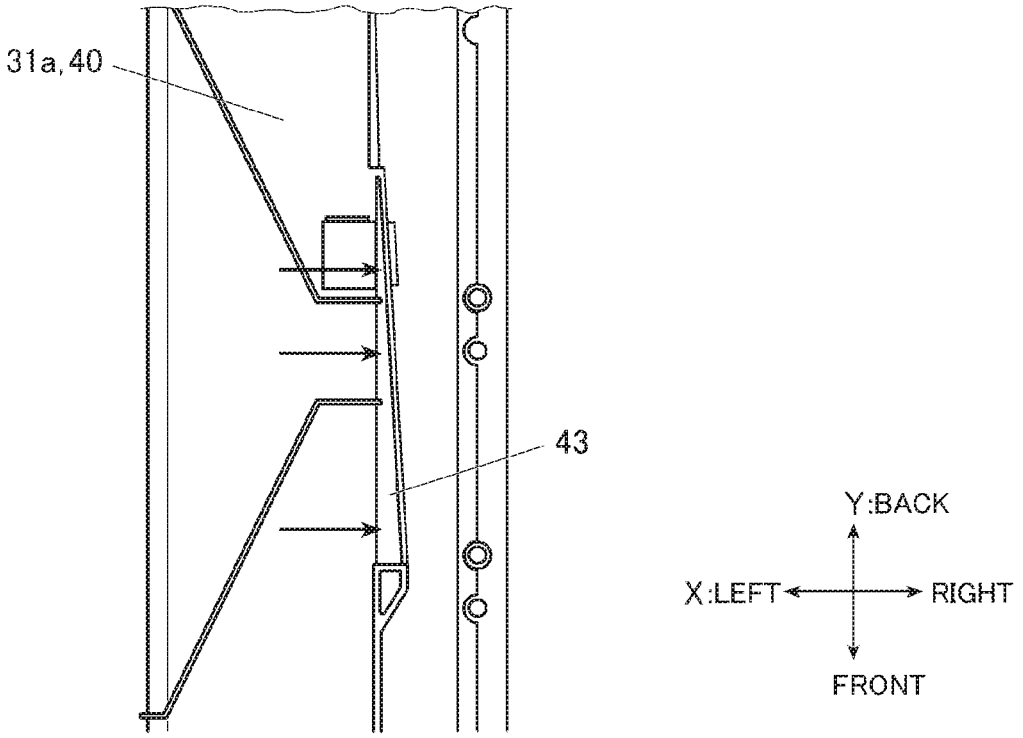
FIG. 6 is an enlarged view of a main part of a suction duct.
Figure 7:
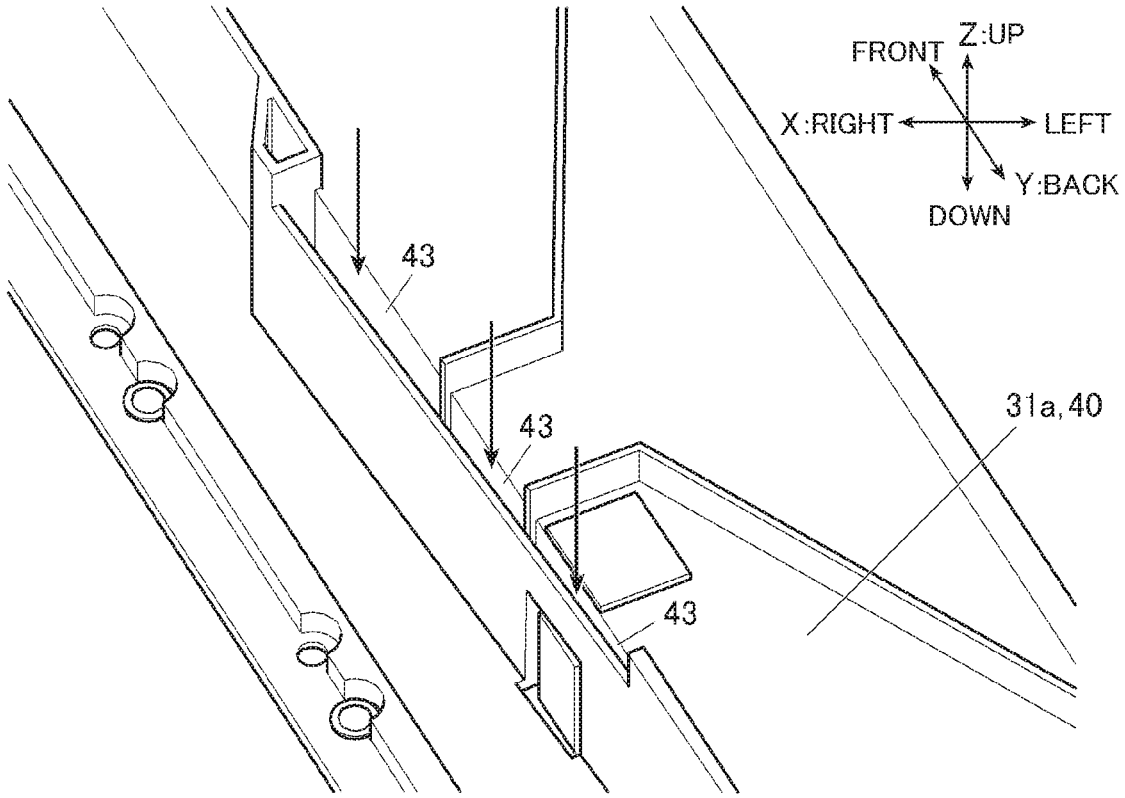
FIG. 7 is a perspective view of the main part of the suction duct.

FIG. 6 and FIG. 7 are an enlarged view and a perspective view of a main component(s) disposed in a region R shown in FIG. 4, respectively.

As shown in FIG. 6 and FIG. 7, on the lower surface of the suction duct 40 (i.e. the upper surface 31*a* of the case 31), a recess 43 as the carrier catcher is formed.

The recess 43 is a groove formed vertically downward from the lower surface of the path of the suction duct 40 (the upper surface 31*a* of the case 31).

The recess 43 extends along a direction (Y direction) that intersects with a flow direction (X direction) of air flow by which the scattered toner is sucked and the vertical direction (Z direction). The recess 43 is disposed along the exhaust port 42, and has a length covering the exhaust port 42 at least.

It is preferable that the recess 43 be disposed downstream in the flow direction (X direction) of air flow in the path of the suction duct 40, namely near the exhaust port 42 of the suction duct 40, in order to obtain a higher catching effect.

Further, it is preferable that the recess 43 be formed such that its width in the X direction is wider on the front side than on the back side in the Y direction. That is, it is preferable that the recess 43 be formed such that a portion corresponding to the upstream portion of a circulation path for the developer in the case 31 is larger than a portion corresponding to the downstream portion of the circulation path.

The recess 43 is formed as described above because distribution of the carrier on the first developing roller 34*a* tends to be higher upstream of toner circulation than downstream thereof and accordingly the carrier is more scattered upstream of toner circulation, thereby being able to obtain a higher catching effect.

Figure 8:
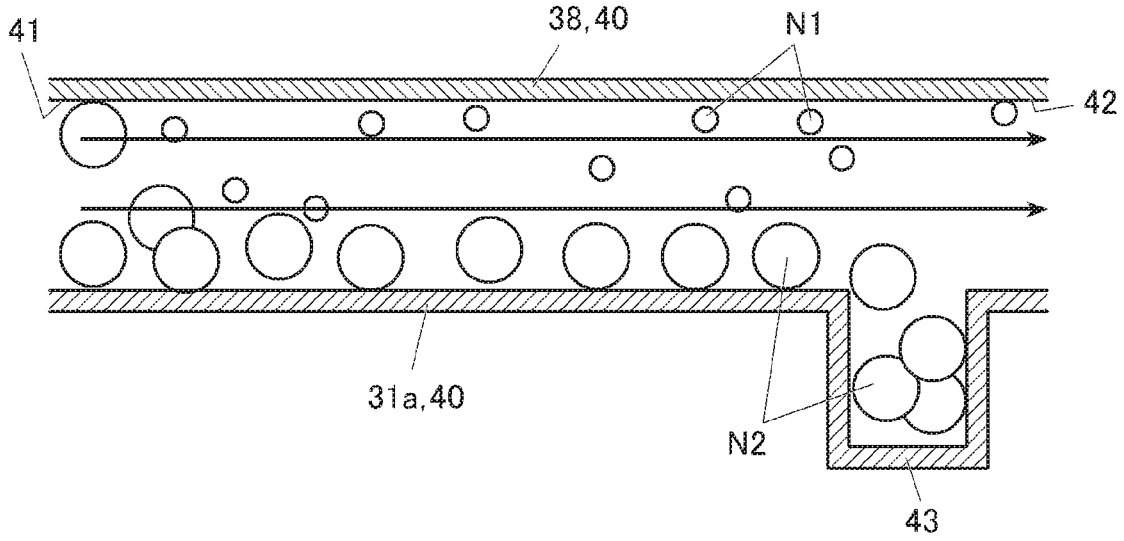
FIG. 8 is an illustration for explaining an effect of a carrier catcher.

FIG. 8 is an illustration for explaining the effect of the recess 43.

As shown in FIG. 8, when the suction duct 40 sucks carrier particles N2 together with toner particles N1, the carrier particles N2 are deposited on the lower surface of the path of the suction duct 40 due to their weights, and gradually conveyed in the path toward the exhaust port 42.

When the carrier particles N2 reach the recess 43, they fall into the recess 43 by their own weights and are accumulated in the recess 43. Hence, the carrier particles N2 can be prevented from entering the path over there.

Thus, the recess 43 can prevent the carrier from entering the main-body-side duct 60, which is difficult to clean. Further, as described above, because the suction duct 40 is detachable, the carrier accumulated in the recess 43 can be removed at the time of cleaning.

Needless to say, the shape or the like of the recess 43 is not limited to the one shown in FIG. 8 or the like.

Figure 9A:
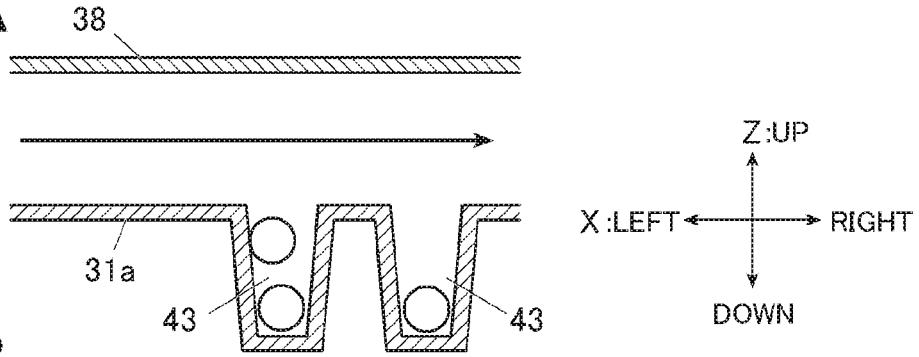
FIG. 9A shows a modification of the carrier catcher.
Figure 9B:
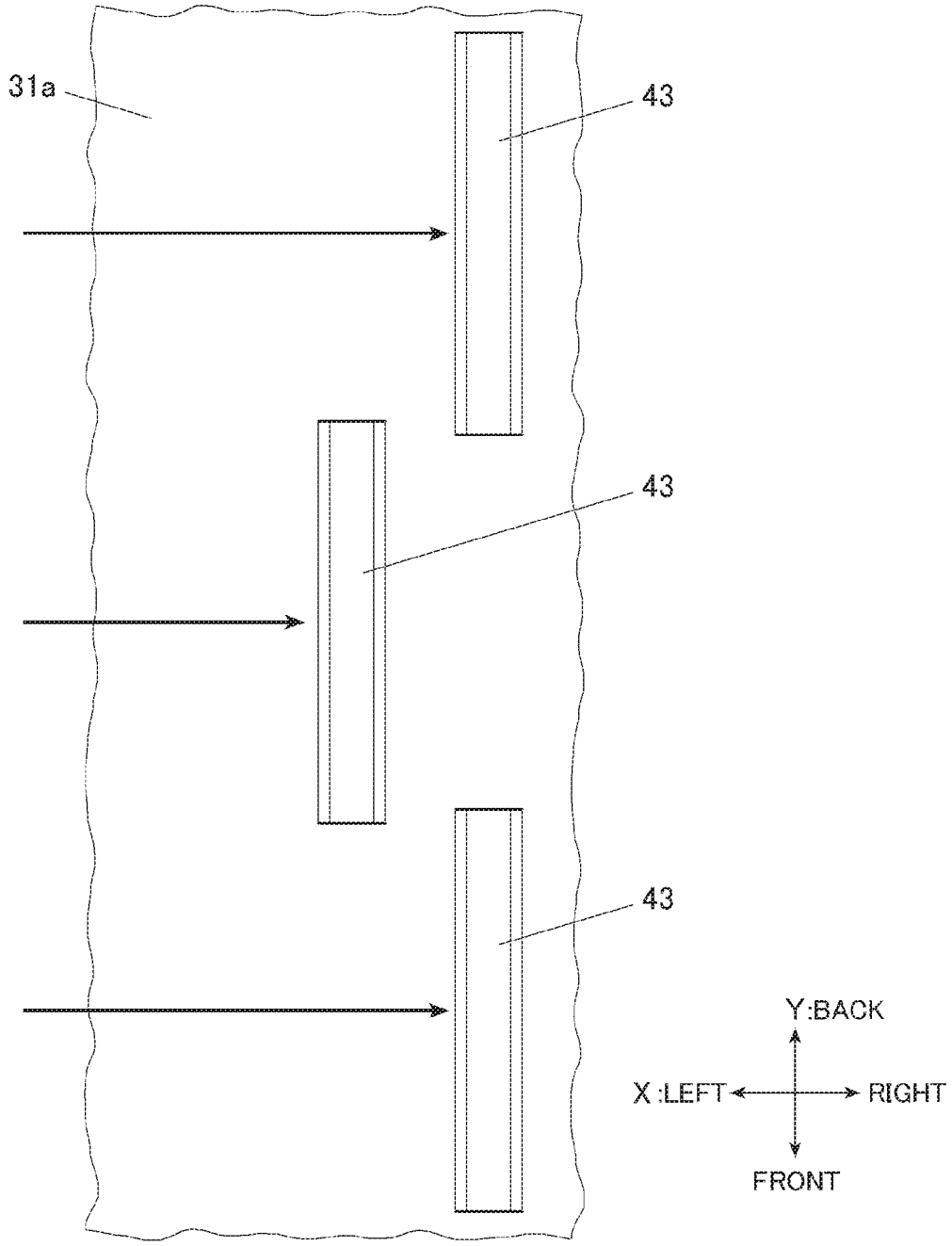
FIG. 9B shows a modification of the carrier catcher.

For example, as shown in FIG. 9A, a plurality of lines of recesses 43 may be provided, or as shown in FIG. 9B, a plurality of lines of recesses 43 may be arranged so as to be staggered in a top view.

Figure 10A:
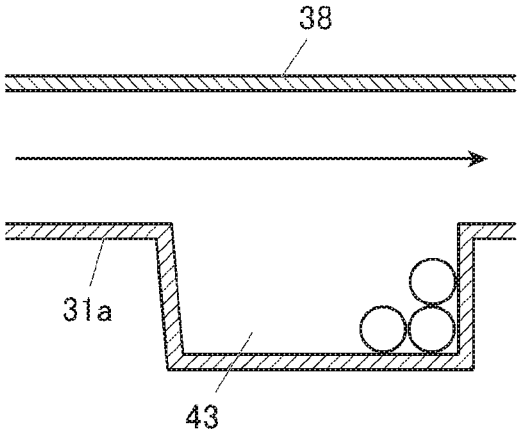
FIG. 10A shows a modification of the carrier catcher.

The size of the recess 43 in the X direction is not limited, either. For example, as shown in FIG. 10A, the size of the recess 43 in the X direction may be expanded to be the same as or similar to the added-up size of the plurality of lines of recesses 43 shown in FIG. 9A.

Figure 10B:
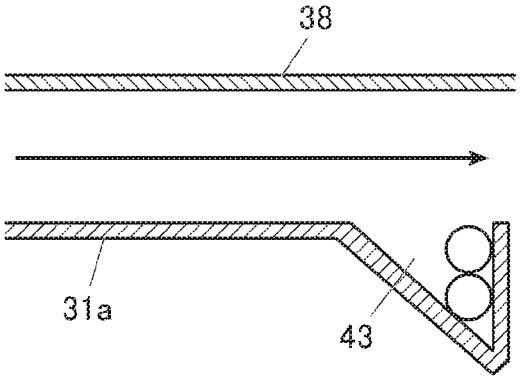
FIG. 10B shows a modification of the carrier catcher.
Figure 10C:
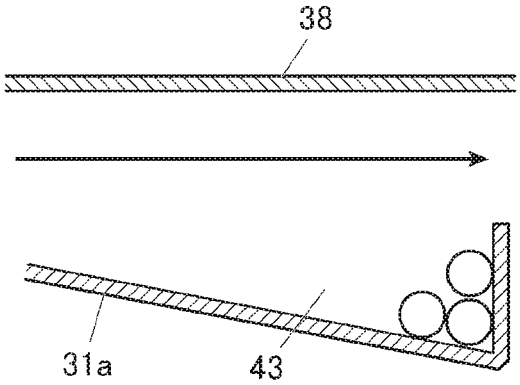
FIG. 10C shows a modification of the carrier catcher.

The cross-sectional shape of the recess 43 is not limited, either. For example, as shown in FIG. 10B, the cross-sectional shape thereof may be an inverted triangle, or, although not shown, a circular arc or the like. Alternatively, as shown in FIG. 10C, the bottom surface of the recess 43 and the lower surface of the suction duct 40 (the upper surface 31*a* of the case 31) may be continuous (no angle therebetween).

Figure 11A:
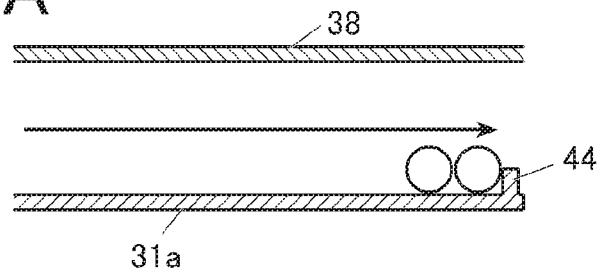
FIG. 11A shows a modification of the carrier catcher.
Figure 11B:
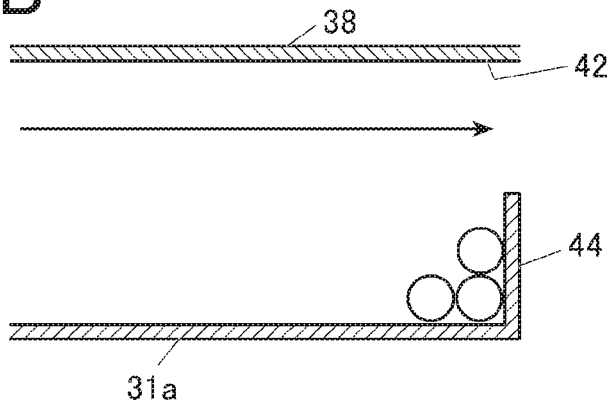
FIG. 11B shows a modification of the carrier catcher.

Other than the recess(es) 43, the carrier catcher may be a wall 44 formed to be erect vertically upward from the lower surface of the path of the suction duct 40 as shown in FIG. 11A. As shown in FIG. 11B, the depth (height in the Z direction) of the suction duct 40 may be expanded, and a wall formed to be erect at an end of the lower surface of the suction duct 40 (the upper surface 31*a* of the case 31) may be made to function as the wall 44 as the carrier catcher.

Figure 11C:
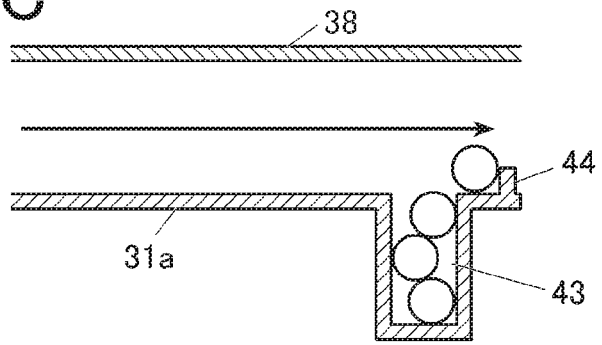
FIG. 11C shows a modification of the carrier catcher.
Figure 11D:
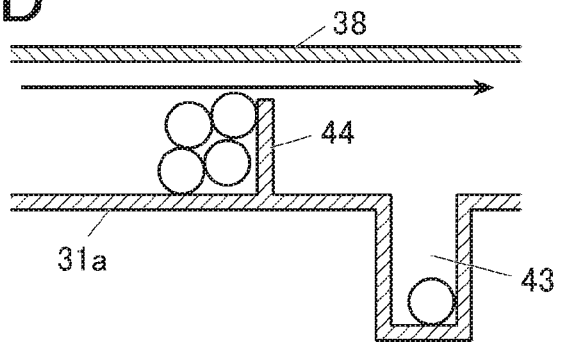
FIG. 11D shows a modification of the carrier catcher.

As shown in FIG. 11C and FIG. 11D, the carrier catcher may be composed of both the recess 43 and the wall 44. The carrier catcher composed of both the recess 43 and the wall 44 may be configured, as shown in FIG. 11C, such that the recess 43 is disposed upstream in the X direction and the wall 44 is disposed downstream in the X direction, so that the carrier (carrier particles) not caught by (fallen into) the recess 43 is checked (blocked) by the wall 44, or may be configured, as shown in FIG. 11D, such that the wall 44 is disposed upstream in the X direction and the recess 43 is disposed downstream in the X direction, so that the carrier (carrier particles) not checked (blocked) by the wall 44 is caught by (fallen into) the recess 43.

Advantageous Effects of Embodiment

As described above, according to this embodiment, the developing device 30 includes: the case 31 that accommodates a developer containing a toner and a carrier; the developing roller 34*a* that is disposed so as to face the photoconductor 12 disposed outside the case 31 and supplies the developer to the photoconductor 12; the suction duct 40 that sucks and collects a scattered toner floating in a space around the developing roller 34*a*; and the carrier catcher that is formed in the vertical direction and disposed on the lower surface of the path of the suction duct 40.

Consequently, the carrier that has entered the suction duct 40 can be caught by the carrier catcher. Thus, the carrier can be prevented from entering the main body side.

According to this embodiment, the carrier catcher includes at least one of the recess 43 formed downward in the vertical direction from the lower surface of the path of the suction duct 40 and the wall 44 formed to be erect upward in the vertical direction from the lower surface of the path of the suction duct 40.

Consequently, the carrier can be dropped into the recess 43 or checked by the wall 44. Thus, the carrier that has entered the suction duct 40 can be caught.

According to this embodiment, the carrier catcher is disposed downstream in the flow direction of air flow in the path of the suction duct 40.

Thus, the carrier catcher is arranged at a position where the carrier (carrier particles) is likely to be accumulated, and hence the carrier can be effectively caught.

According to this embodiment, the carrier catcher extends along the direction that intersects with the flow direction of air flow in the path of the suction duct 40 and the vertical direction.

Thus, the carrier catcher is arranged so as to intersect with the direction in which the carrier moves, and hence the carrier can be effectively caught.

According to this embodiment, the suction duct 40 is formed such that the width of the path of the suction duct 40 becomes narrower from the intake port 41 to the exhaust port 42, and the carrier catcher is disposed along the exhaust port 42.

Thus, the carrier catcher is arranged at a position where the carrier (carrier particles) is likely to be accumulated, and hence the carrier can be effectively caught.

According to this embodiment, the carrier catcher may be disposed in multiple lines, and further may be disposed in the multiple lines so as to be staggered.

These can enhance the catching effect.

According to this embodiment, the carrier catcher is formed such that a portion corresponding to the upstream portion of the circulation path for the developer in the case 31 is larger than a portion corresponding to the downstream portion of the circulation path.

Thus, the carrier catcher is arranged at a position where the carrier (carrier particles) is likely to be accumulated, and hence the carrier can be effectively caught.

According to this embodiment, the developing device 30 includes the developing rollers 34*a*, 34*b*, and the intake port 41 of the suction duct 40 is disposed on the downstream side of the developing roller 34*a* disposed most downstream between the developing rollers 34*a*, 34*b* in the rotation direction of the photoconductor 12.

Thus, the intake port 41 of the suction duct 40 can be arranged at a position most suitable for sucking the scattered toner.

According to this embodiment, one surface of the path of the suction duct 40 is constituted by a wall surface of the case 31. More specifically, the developing device 30 further includes the cover 38 that is disposed above the case 31 and covers the case 31, and the upper surface of the suction duct 40 is constituted by the cover 38, and the lower surface of the suction duct 40 is constituted by the upper surface 31*a* of the case 31.

Consequently, the developing device 30 can have the suction duct 40 without increasing the number of components.

According to this embodiment, the cover 38 is detachable from and attachable to the case 31.

This makes cleaning of the suction duct 40 easy.

According to this embodiment, the suction duct 40 is detachable from and attachable to the main-body-side duct 60 disposed in the main body of the image forming apparatus 100.

This makes cleaning of the suction duct 40 easy.

Others

In the above embodiment, the connector 50 is a separate component, but may be integrated with the main-body-side duct 60 or the suction duct 40.

Further, in the above embodiment, one surface (lower surface) of the suction duct 40 is configured by one surface of the case 31, but the suction duct 40 may be a component separate from the case 31.

Further, in the above embodiment, two developing rollers 34*a*, 34*b* are provided, but the number of developing rollers may be one. In this case too, the intake port 41 of the suction duct 40 is disposed on the downstream side of the developing roller in the rotation direction of the photoconductor 12 in order to enhance the effect of sucking the scattered toner.

Although one or more embodiments of the present invention have been described and illustrated in detail, the disclosed embodiments are made for purposes of not limitation but illustration and example only. The scope of the present invention should be interpreted by terms of the appended claims.

What is claimed is:

1. A developing device comprising:

a case that accommodates a developer containing a toner and a carrier;

a developer holder that is disposed so as to face an image holder disposed outside the case and supplies the developer to the image holder;

a suction duct that sucks and collects a scattered toner floating in a space around the developer holder; and a carrier catcher that is formed in a vertical direction and disposed on a lower surface of a path of the suction duct, wherein the carrier catcher includes at least one of (i) a recess formed downward in the vertical direction from the lower surface of the path of the suction duct, and (ii) a wall formed to be erect upward in the vertical direction from the lower surface of the path of the suction duct.

2. The developing device according to claim 1, wherein the carrier catcher is disposed downstream in a flow direction of air flow in the path of the suction duct.

3. A developing device comprising:

a case that accommodates a developer containing a toner and a carrier;

a developer holder that is disposed so as to face an image holder disposed outside the case and supplies the developer to the image holder;

a suction duct that sucks and collects a scattered toner floating in a space around the developer holder; and a carrier catcher that is formed in a vertical direction and disposed on a lower surface of a path of the suction duct, wherein the carrier catcher extends along a direction that intersects with a flow direction of air flow in the path of the suction duct and the vertical direction.

4. The developing device according to claim 3, wherein the suction duct is formed such that a width of the path of the suction duct becomes narrower from an intake port to an exhaust port, and wherein the carrier catcher is disposed along the exhaust port.

5. The developing device according to claim 3, wherein the carrier catcher is disposed in multiple lines.

6. The developing device according to claim 5, wherein the carrier catcher is disposed in the multiple lines so as to be staggered.

7. The developing device according to claim 3, wherein the carrier catcher is formed such that a portion corresponding to an upstream portion of a circulation path for the developer in the case is larger than a portion corresponding to a downstream portion of the circulation path.

8. The developing device according to claim 1, wherein the developer holder includes a plurality of developer holders, and wherein an intake port of the suction duct is disposed on a downstream side of a developer holder disposed most downstream among the developer holders in a rotation direction of the image holder.

9. The developing device according to claim 1, wherein one surface of the path of the suction duct is constituted by a wall surface of the case.

10. A developing device comprising:

a case that accommodates a developer containing a toner and a carrier;

a developer holder that is disposed so as to face an image holder disposed outside the case and supplies the developer to the image holder;

a suction duct that sucks and collects a scattered toner floating in a space around the developer holder;

a carrier catcher that is formed in a vertical direction and disposed on a lower surface of a path of the suction duct; and a cover that is disposed above the case and covers the case, wherein an upper surface of the suction duct is constituted by the cover, and the lower surface of the suction duct is constituted by an upper surface of the case.

11. The developing device according to claim 10, wherein the cover is detachable from and attachable to the case.

12. The developing device according to claim 1, wherein the suction duct is detachable from and attachable to a main-body-side duct disposed in a main body of an image forming apparatus.

13. An image forming apparatus comprising the developing device according to claim 1.

14. The developing device according to claim 3, wherein the carrier catcher includes at least one of (i) a recess formed downward in the vertical direction from the lower surface of the path of the suction duct, and (ii) a wall formed to be erect upward in the vertical direction from the lower surface of the path of the suction duct.

15. The developing device according to claim 10, wherein the carrier catcher includes at least one of (i) a recess formed downward in the vertical direction from the lower surface of the path of the suction duct, and (ii) a wall formed to be erect upward in the vertical direction from the lower surface of the path of the suction duct.

* * * * *